US009016100B2

(12) United States Patent
Clark et al.

(10) Patent No.: US 9,016,100 B2
(45) Date of Patent: Apr. 28, 2015

(54) FULLY HYDRAULIC EDGER FOR PLATE MILLS

(75) Inventors: Michael Trevor Clark, Yorkshire (GB); John Franey, Yorkshire (GB); Martyn Jones, Dorset (GB); Andrew Mallison, Yorkshire (GB)

(73) Assignee: Siemens PLC, Surrey (GB)

( * ) Notice: Subject to any disclaimer, the term of this patent is extended or adjusted under 35 U.S.C. 154(b) by 611 days.

(21) Appl. No.: 13/260,622

(22) PCT Filed: Feb. 9, 2010

(86) PCT No.: PCT/EP2010/051549

§ 371 (c)(1), (2), (4) Date: Dec. 16, 2011

(87) PCT Pub. No.: WO2010/108725

PCT Pub. Date: Sep. 30, 2010

(65) Prior Publication Data

US 2012/0090373 A1 Apr. 19, 2012

(51) Int. Cl.

| | |
|---|---|
| ***B21B 31/32*** | (2006.01) |
| ***B21J 9/18*** | (2006.01) |
| ***B21B 13/06*** | (2006.01) |

(52) U.S. Cl.

CPC ..... *B21B 13/06* (2013.01); *B21B 31/32* (2013.01)

(58) Field of Classification Search

CPC .. B21B 1/224; B21B 2035/005; B21B 31/16; B21B 31/32; B21B 35/02; B21C 51/00

USPC ..... 72/245, 237, 241.6, 248, 249, 72/453.01–453.19, 225, 234, 235; 100/159, 170

See application file for complete search history.

(56) References Cited

U.S. PATENT DOCUMENTS

| | | | | |
|---|---|---|---|---|
| 2,169,113 | A * | 8/1939 | Sheppard | 72/412 |
| 4,590,778 | A * | 5/1986 | Klockner et al. | 72/14.7 |
| 4,803,862 | A | 2/1989 | Schulze et al. | 72/199 |
| 5,237,916 | A * | 8/1993 | Malashenko | 100/269.14 |
| 6,786,071 | B2 | 9/2004 | Thiele | 72/7.5 |
| 6,941,783 | B2 * | 9/2005 | Yamanaka et al. | 72/17.2 |
| 2008/0134909 | A1 * | 6/2008 | Kohno et al. | 100/48 |
| 2009/0025577 | A1 * | 1/2009 | Aoki et al. | 100/35 |

(Continued)

FOREIGN PATENT DOCUMENTS

| | | | |
|---|---|---|---|
| DE | 3624958 A1 | 2/1988 | B21B 31/24 |
| EP | 0868946 A2 | 10/1998 | B21B 37/22 |

(Continued)

OTHER PUBLICATIONS

International PCT Search Report and Written Opinion, PCT/EP2010/051549, 12 pages, Jul. 6, 2010.

(Continued)

*Primary Examiner* — Jimmy T Nguyen
*Assistant Examiner* — Gregory Swiatocha
(74) *Attorney, Agent, or Firm* — King & Spalding L.L.P.

(57) ABSTRACT

A fully hydraulic edging system suitable for use in wide plate mills is disclosed. The need for electro-mechanical screws to effect large movements of the side rollers is avoided by employing a pull-back hydraulic cylinder for this purpose. The main hydraulic cylinders are switched to a non-operational mode during large movements thus avoiding the need for large volumes of hydraulic fluid to be transferred under high pressure.

14 Claims, 4 Drawing Sheets

(56) References Cited

U.S. PATENT DOCUMENTS

| | | | | |
|---|---|---|---|---|
| 2010/0229705 | A1* | 9/2010 | Christoforou et al. | 83/56 |
| 2011/0030437 | A1* | 2/2011 | Eckelsbach et al. | 72/245 |

FOREIGN PATENT DOCUMENTS

| | | | | |
|---|---|---|---|---|
| JP | 58033101 | U | 3/1983 | B21B 13/06 |
| JP | 60129407 | A | 7/1985 | B21B 13/06 |
| JP | 62101305 | A | 5/1987 | B21B 13/06 |
| JP | 62124062 | A | 6/1987 | B22D 17/26 |
| JP | 63047001 | U | 3/1988 | B21B 13/06 |
| JP | 63111206 | U | 7/1988 | B21B 31/20 |
| JP | 2002031101 | A | 1/2002 | F15B 11/01 |
| WO | 91/04106 | A | 4/1991 | B21B 13/06 |
| WO | WO 9104106 | A1 * | 4/1991 | |
| WO | 02/26408 | A1 | 4/2002 | B21B 1/26 |
| WO | 2010/108725 | A1 | 9/2010 | B21B 13/06 |

OTHER PUBLICATIONS

Fogel, G.D.R., "Revamping the Hot Strip Mill at Egyptian Iron & Steel" Steel Times International, DMG World Media, vol. 20, No. 2, pp. 23,25,28; XP000590164 ISSN: 0143-7798, Mar. 1, 1996.

British Search Report, Application No. 0905263.0, 1 page, Jun. 24, 2009.

* cited by examiner

FULLY HYDRAULIC EDGER FOR PLATE MILLS

CROSS-REFERENCE TO RELATED APPLICATIONS

This application is a U.S. National Stage Application of International Application No. PCT/EP2010/051549 filed Feb. 9, 2010, which designates the United States of America, and claims priority to GB Patent Application No. 0905263.0 filed Mar. 27, 2009. The contents of which are hereby incorporated by reference in their entirety.

TECHNICAL FIELD

The invention is concerned with the field of plate metal rolling and, in particular with the edging operation during which the plate is passed through vertical rollers to achieve a desired and constant width.

BACKGROUND

In hot strip mills, plate-steckel mills and some narrow plate mills, movement of the rollers necessary for width adjustment is typically achieved using hydraulic cylinders.

However, in plate mills both cylinders and mechanical screws are used for the width adjustment because very large movements of the rollers at high speeds is necessary. In order to provide such movements by the cylinders historically used for the edging operation, very large quantities of hydraulic fluid would need to be transferred at high flow rates. This in turn would require large hydraulic pumping systems, servo valves, conduits etc.

Nevertheless, hydraulic cylinders offer a relatively cheap, simple and low-maintenance option and a system allowing use of these in the plate environment represents a desirable advance in the art.

SUMMARY

According to an embodiment, an apparatus for edge rolling of metal plates may comprise: a roller mounted in a chock; at least one edging hydraulic cylinder having a relatively large working area; at least one further hydraulic cylinder having a relatively small working area; each cylinder having an associated piston wherein the pistons are mechanically linked such that movement of one causes movement of the other; a source of pressurised hydraulic fluid and associated means for selectively directing said pressurised fluid to the cylinders to cause movement of the pistons therein; the apparatus being switchable between a first mode of operation in which pressurised hydraulic fluid is directed to the edging hydraulic cylinder thereby to effect relatively small movement of the chock and a second mode of operation in which the edging hydraulic cylinder is substantially isolated from pressurised hydraulic fluid and the pressurised hydraulic fluid is directed to the further hydraulic cylinder to effect relatively large movement of the chock.

According to another embodiment, the apparatus may further comprise a source of hydraulic fluid and associated means for directing fluid therefrom to the edging hydraulic cylinder in the second mode of operation. According to another embodiment, the apparatus may further comprise a conduit arranged to provide fluid communication between regions of the interior of the edging hydraulic cylinder on either side of the piston and a valve, operable to block said fluid communication. According to another embodiment, the conduit and valve can be embedded in the piston. According to another embodiment, the apparatus may further comprise at least one piston rod connected to a piston and caused to move in an axial direction thereby; the piston rod also being connected to the chock by a flexible connection allowing movement of the rod relative to the chock in a direction at a right angle to the axial direction. According to another embodiment, the means for selectively directing pressurised hydraulic fluid to the cylinders may be operable to direct said hydraulic fluid to the further hydraulic cylinder at a constant pressure in the first mode of operation, thereby to maintain contact between the chock and the pistons associated with each edging hydraulic cylinder. According to another embodiment, the apparatus may further comprise means for determining the position of the further hydraulic cylinder and wherein the means for selectively directing pressurised hydraulic fluid to the cylinders is operable to direct said hydraulic fluid to the further hydraulic cylinder responsive to said position in the second mode of operation.

BRIEF DESCRIPTION OF THE DRAWINGS

The invention will now be described with reference to the following figures in which.

DETAILED DESCRIPTION

Apparatus according to various embodiments utilises at least two types of hydraulic cylinder: a first, edging, cylinder having a relatively high working area, which is used to effect the relatively small movements of the rollers that are made during the edging process and at least one further cylinder, having a relatively small working area, which is used to effect the relatively large movements of the roller associated with slab turning or maintenance.

In the following examples this further type of cylinder, having a smaller working area, is conveniently realised as a modification of the 'pull back' cylinder commonly found in the prior art, but this should not be seen as limiting. Another cylinder, additional to the pull back cylinder, could be employed.

Figure 1:
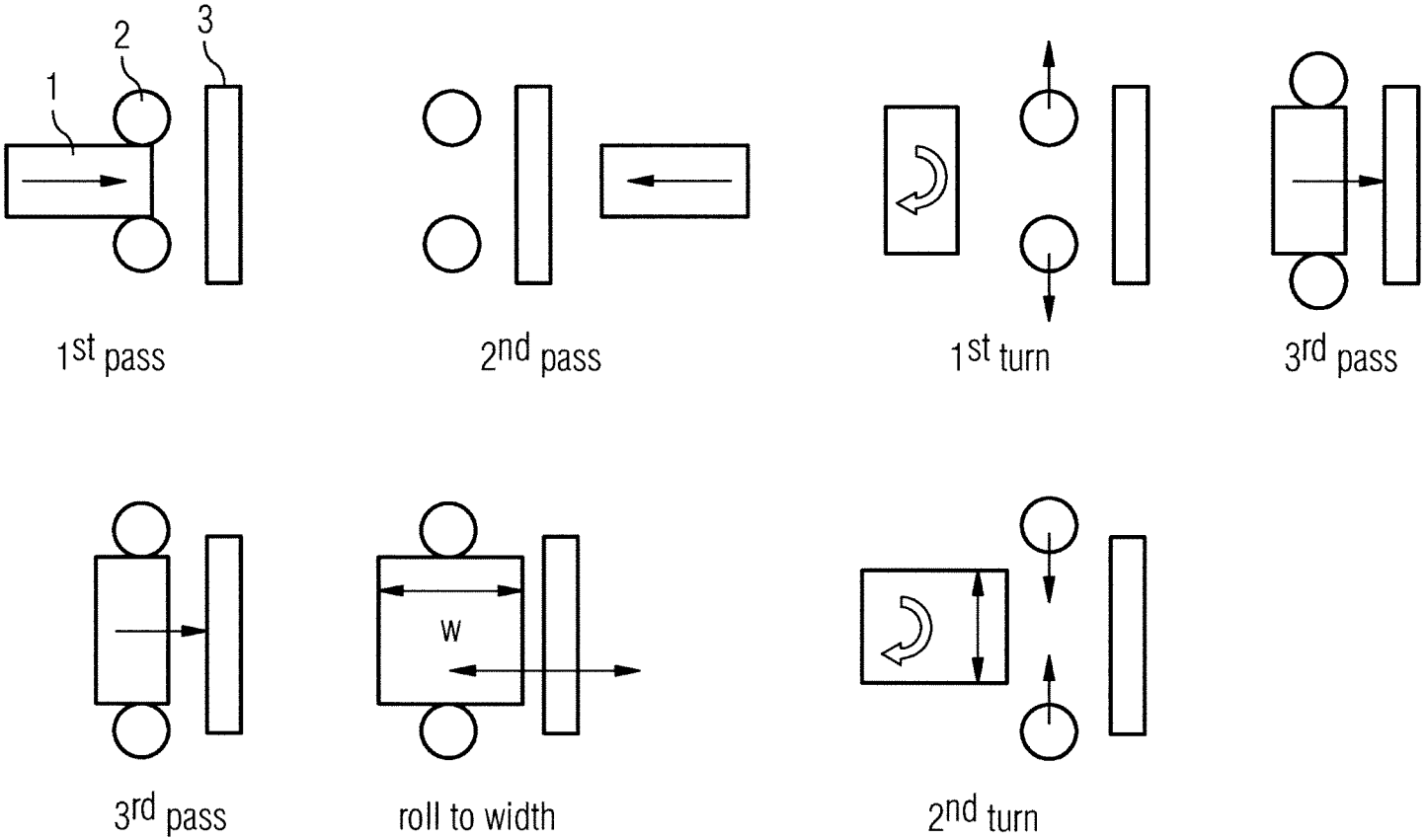
FIG 1 (PRIOR ART)
FIG. 1 illustrates a part of the rolling operation typically employed in plate mills.

Referring to FIG. 1, in a typical rolling and turning sequence employed in a plate mill according to the prior art, the width of the slab 1 is the as-cast width for the first two passes and the edger rolls 2 must be set at approximately this width. After the $2^{nd}$ pass the slab is turned through ninety degrees on a turntable and the edger rolls have to make a large movement to accommodate the slab broadside on. After the turn the slab is then rolled broadside on until the width of the slab reaches the desired final width. The slab is then turned again at which point the edger rolls have to make another large movement.

On a wide plate mill the large movements of the edger rolls when the slab is turned can easily be between one and two meters on each side of the edger. The slab is typically 1.6 to 2.4 meters wide whereas the broadside dimension could be up to 4.9 meters or even more. Also, these movements have to be made relatively quickly—a few seconds—so that the process is not slowed down.

Also, in a fully hydraulic edger the cylinders have to have a large enough working area (the area acted on by hydraulic fluid to effect displacement) to produce the necessary edging force—typically 500 tonnes or more—at a practical hydraulic pressure.

This combination of large working area cylinders and large movements at high speed means that a conventional fully hydraulic edger is unsuitable for use in a wide plate mill.

For these reasons, edgers for wide plate mills normally have both screws and hydraulic cylinders. The screws are used for the large movements in between edging passes and the cylinders are used for small movements and width corrections during the edging passes.

Figure 2:
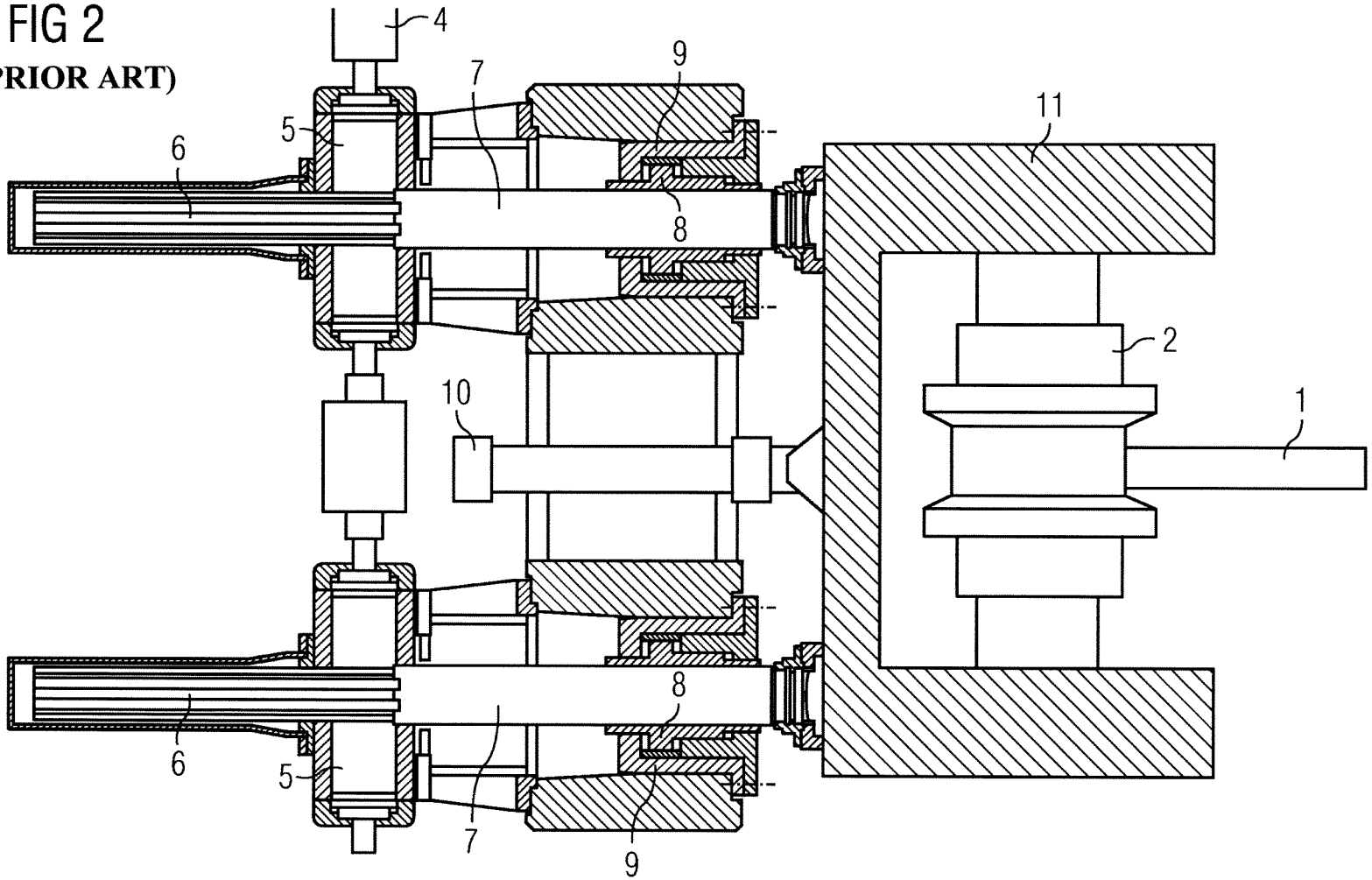
FIG 2 (PRIOR ART)
FIG. 2 illustrates one half of a typical conventional wide plate mill edger.

Referring to FIG. 2, in order to control the width of the slab 1 in a typical wide plate mill according to the prior art, the position of the edger roll 2 and chock 11 are adjusted. (The figure represents one half of the adjustable edger system, each of the components shown being reflected in a corresponding component (not shown) arranged at the other side of the slab 1.) In practice the chock 11 is often split into a chock carrier and a chock proper. The chock carrier stays in the edger at roll change whereas the roll and chock are exchanged. For simplicity item 11 represents both the chock and the chock carrier. For large movements, in between edging passes, the motor 4 drives the worm gears 5 which rotate the screws 7 via the splines 6. The screws 7 rotate in the nuts 8 and hence move the chock 3 and the roll 2 in or out. For smaller movements during edging the hydraulic cylinders 9 are used. The nuts 8 are part of the piston within the hydraulic cylinders 9. A hydraulic servo valve system is used to control the flow of oil into or out of the cylinders 9 and thus move the piston and nut 8 and hence the screws 7 and the roll chock 3 and roll 2. The hydraulic cylinder 10 is commonly known as the pullback cylinder. The job of the pullback cylinder 10 is to make sure that the chock 11 remains in contact with the screws 7 even when edger roll gap is opening. The pullback hydraulic cylinder 10 usually operates at a constant pressure but in some cases the pressure is adjusted depending on the whether the edger roll gap is being opened or closed.

In some cases the pullback cylinder incorporates a position transducer which is used for feedback of the position of the roll chock and for control of the screw and/or hydraulic cylinder position. However, even when a position transducer is built into the pullback cylinder, it is not normally used for position control of the pullback cylinder itself. In normal operation the pullback cylinder is not position controlled directly and it simply follows the movement of the screws. The exception to this is during roll change when, in some cases, the pullback cylinder may be used for positioning the edger roll 2 and chock 11 during a roll change. During a roll change the edger roll 2 and chock 11 are moved away from the screws and exchanged for a new set.

Figure 3:
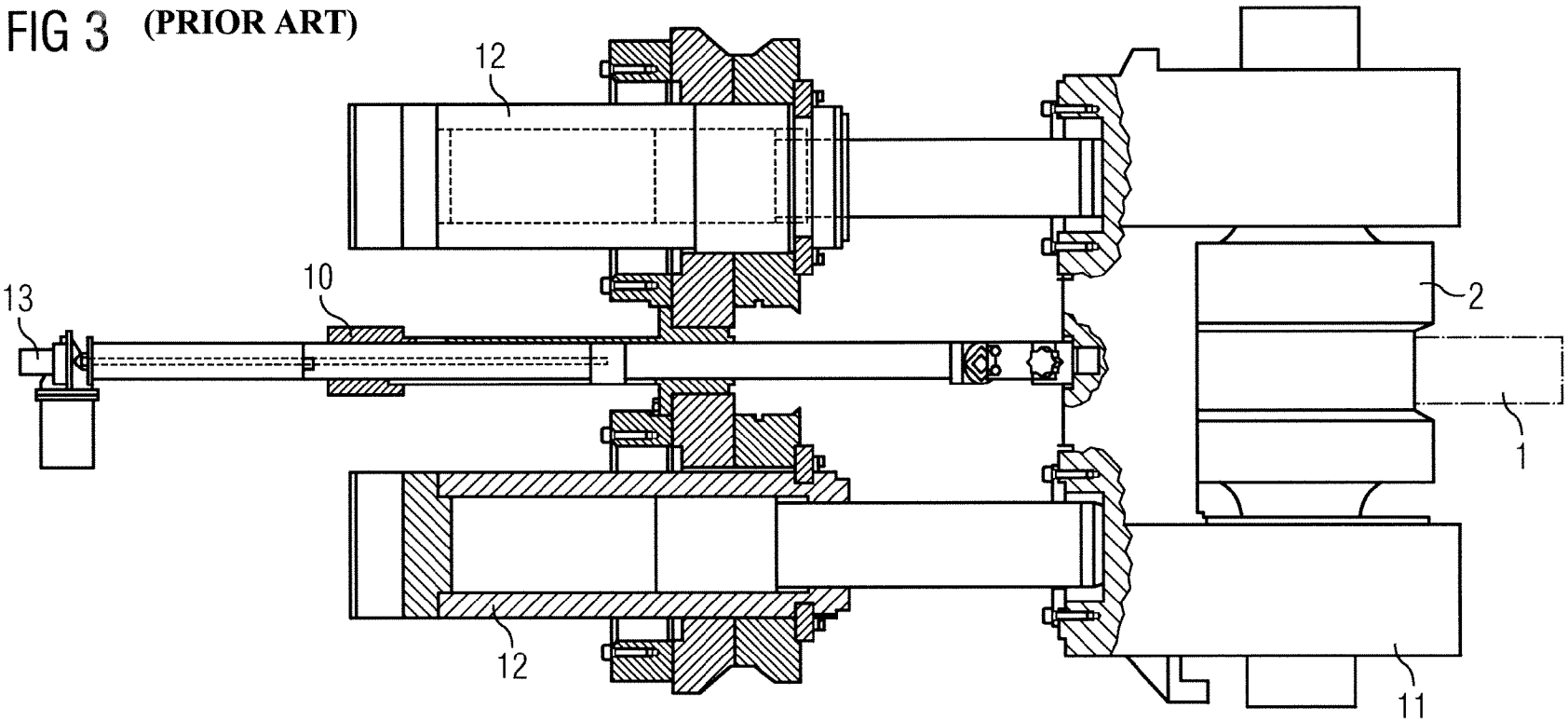
FIG 3 (PRIOR ART)
FIG. 3 illustrates one half of a typical fully hydraulic edger as conventionally used.

Referring to FIG. 3, in a fully hydraulic edger according to the prior art, the width of the slab 1 is controlled by adjusting the position of the edger roll 2 and chock 11 together with corresponding components on the other side of the slab 1. In the case of a fully hydraulic edger all of the movements are done by the long stroke hydraulic load cylinders 12. Both large movements to accommodate a new slab width and small movements under load during the edging passes are done using the long stroke cylinders 12. The pullback cylinder 10 works in the same way as that described above—it pulls the chock 11 back against the long stroke cylinders 12 to ensure that the chock remains in contact even when the roll gap is opened. In the example illustrated in FIG. 3 the pullback cylinder incorporates a position transducer 13 which is used for feedback of the chock position. However, in normal operation, the pullback itself is not position controlled it simply exerts a constant force and follows the movement of the long stroke load cylinders 12. The exception to this is during roll change when in some cases the pullback cylinder is used to position the roll and chock.

Figure 4:
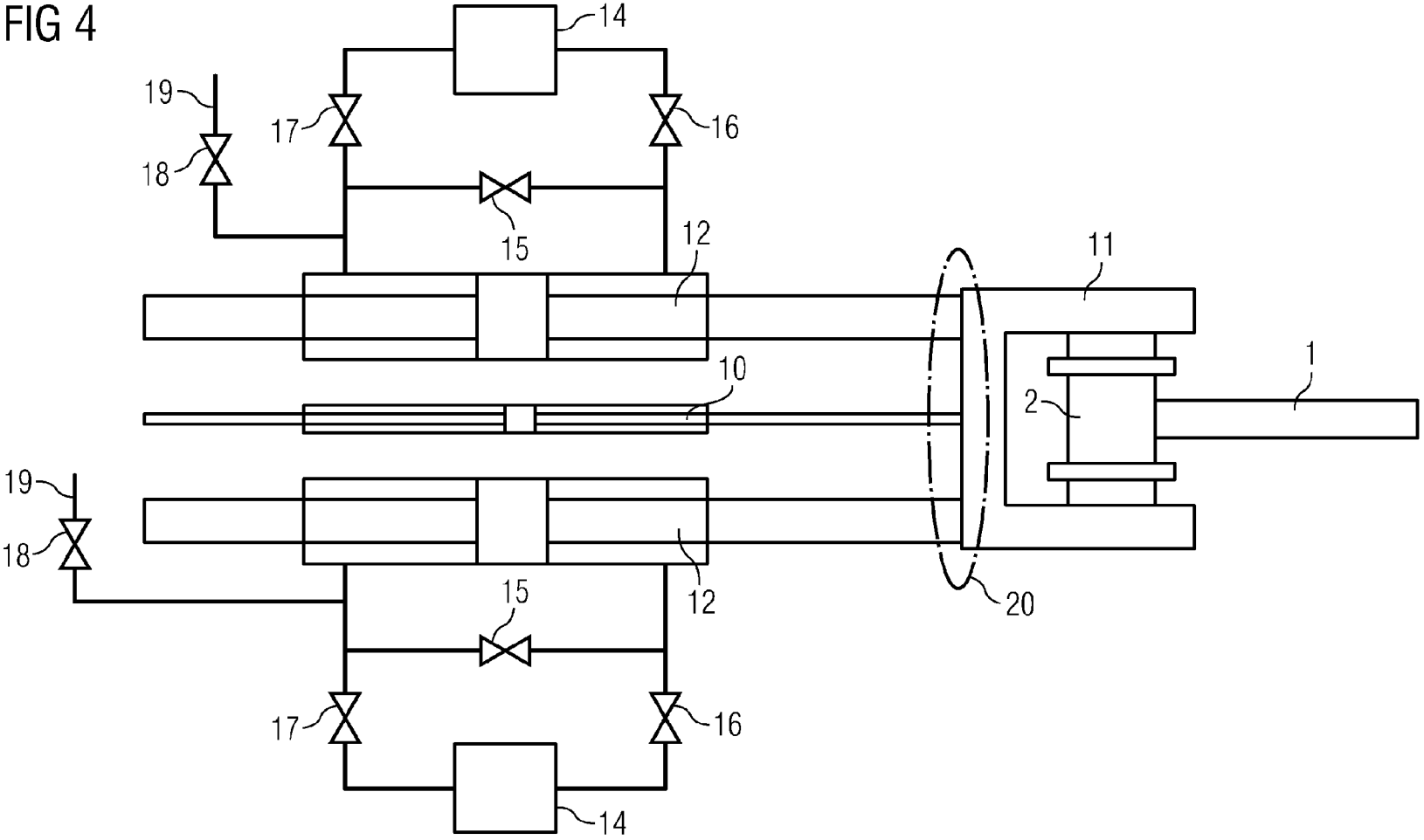
FIG. 4 illustrates one half of a fully hydraulic edger according to various embodiments.

Referring to FIG. 4, a fully hydraulic edger according to various embodiments has two modes of operation. During the actual edging passes when short movements are required with high force the main cylinders 12 are used. However for long stroke movements between passes the main cylinders 12 operate in a bypass mode and the movement is achieved by the 'pullback' cylinder 10.

During the edging passes the position of the roll 2 and chock 11 is controlled by the position of the main hydraulic cylinders 12. The main hydraulic cylinders 12 are position controlled using the servo valves 14. The shutoff valves 16 and 17 are open and the bypass valves 15 are closed. The top up valves 18 are also closed. In this mode the main cylinders operate in the same way as in a conventional fully hydraulic edger. The pullback cylinder 10 is operated in a conventional pressure (force) control mode.

When long stroke movements are required, for example when the slab is turned, the shutoff valves 16 and 17 are closed and the bypass valves 15 are opened. This allows fluid to flow from one side of the main cylinder to the other. In this mode the pullback cylinder 10 is position controlled using a separate servo valve (not shown). Because the pullback cylinder is much smaller than the main cylinders the volume of oil required to make the long stroke movement is very much smaller than for a conventional hydraulic edger.

When the main cylinders are in bypass mode the valves 18 are also opened in order to connect the main cylinder to the top up supply 19. This compensates for any net flow required to or from the main cylinders during the long stroke movement e.g. if the cylinder areas are different on the two sides of the piston or there is leakage etc. The top up supply 19 could be a header tank or it could be pressure regulated supply from the main system. Preferably the main cylinders have equal areas on both sides to minimise the net flow required. Of course, if a header tank or large volume low pressure supply is used for top up supply 19 then in principle the system could operate without the bypass valves and just take oil to/from the header tank/low pressure supply.

The pullback cylinder has its own separate servo control system (not shown) which switches between pressure (force) control when the main cylinders are in use and position control for long stroke movements.

Whilst the bypass valves 15 are shown as external valves in FIG. 14 preferably they are built in to the piston (applicants co-pending application GB 0815741.4 discloses such an arrangement). Also the rod on the opposite side from the edger roll and chock could be bolted to the piston (GB 0815741.4 also discloses).

In most conventional edgers the screws 7 are not directly attached to the chock 11. The chock is kept in contact with the screws by the pullback force. Similarly in most conventional hydraulic edgers the chock is not directly attached to the piston rods of the long stroke cylinders 12 and they are kept in contact by the pullback force. The reason that they are not directly attached is to allow some movement of the chock without putting side loads on the screws or cylinders.

However, in the new edger design, In order for the pullback cylinder to be able to move the main cylinders out (i.e. when closing the edger roll gap) it is clear that the piston rods of the main cylinders must be either attached to the edger roll chock 11 or connected to the pullback cylinder 10 by some other means in the region shown as 20. Otherwise the movement of the pullback cylinder would simply leave the main cylinders behind. A method of attachment is required that allows for some sideways movements of the chock. There are obviously many solutions to this including a simple joint with some clearance, a joint with spring loading, a joint with hydraulic loading etc.

What is claimed is:

1. An apparatus for edge rolling of metal plates comprising:

a roller mounted in a chock;

an edging hydraulic cylinder having a first working area;

a further hydraulic cylinder having a second working area smaller than the first working area of the edging hydraulic cylinder;

each of the edging hydraulic cylinder and the further hydraulic cylinder having an associated piston, wherein the pistons are mechanically linked to each other such that (a) movement of the edging hydraulic cylinder causes movement of the further hydraulic cylinder and (b) movement of the further hydraulic cylinder causes movement of the edging hydraulic cylinder;

a source of pressurised hydraulic fluid and a controllable valve system configured to selectively direct said pressurised hydraulic fluid to the edging hydraulic cylinder and the further hydraulic cylinder to cause movement of the respective associated pistons;

a control system programmed to control the controllable valve system between:

a first mode of operation in which the valve system directs pressurised hydraulic fluid to the edging hydraulic cylinder to impart a pressure on the edging hydraulic cylinder to effect a first movement of the chock during an edging pass of a metal plate, and a second mode of operation in which:

(a) the valve system directs the pressurised hydraulic fluid to the further hydraulic cylinder to impart a pressure on the further hydraulic cylinder sufficient to effect a second movement of the chock and a corresponding movement of the edging hydraulic cylinder between successive edging passes of the metal plate, the second movement of the chock having a greater magnitude than the first movement of the chock, and (b) the pressure imparted on the edging hydraulic cylinder by the pressurised hydraulic fluid during the first mode of operation is relieved.

2. The apparatus according to claim 1, further comprising an additional source of hydraulic fluid and associated valve configured to connect the additional source of hydraulic fluid to the edging hydraulic cylinder in the second mode of operation.

3. The apparatus according to claim 1, further comprising a conduit arranged to provide fluid communication between regions of an interior of the edging hydraulic cylinder on first and second sides of the piston associated with the edging hydraulic cylinder and a valve operable to block said fluid communication.

4. The apparatus according to claim 3, wherein the conduit and the valve are embedded in the piston associated with the edging hydraulic cylinder.

5. The apparatus according to claim 1, further comprising a piston rod connected to the piston associated with the edging hydraulic cylinder and caused to move in an axial direction thereby;

the piston rod also being connected to the chock by a connection allowing movement of the chock relative to the piston rod in a direction at a right angle to the axial direction.

6. The apparatus according to claim 1, where the controllable valve system is operable to direct said pressurised hydraulic fluid to the further hydraulic cylinder at a constant pressure in the first mode of operation, thereby to maintain contact between the chock and the piston associated with the edging hydraulic cylinder.

7. The apparatus according to claim 6, wherein the controllable valve system is operable to direct said pressurised hydraulic fluid to the further hydraulic cylinder responsive to a detected position of the further hydraulic cylinder in the second mode of operation.

8. A method for edge rolling of metal plates with a device comprising a roller mounted in a chock; an edging hydraulic cylinder having a first working area; and a further hydraulic cylinder having a second working area smaller than the first working area of the edging hydraulic cylinder; wherein each of the edging hydraulic cylinder and the further hydraulic cylinder has an associated piston, wherein the pistons are mechanically linked to each other such that (a) movement of the edging hydraulic cylinder causes movement of the further hydraulic cylinder and (b) movement of the further hydraulic cylinder causes movement of the edging hydraulic cylinder; and a source of pressurised hydraulic fluid and a controllable valve system configured to selectively direct said pressurised hydraulic fluid to the edging hydraulic cylinder and the further hydraulic cylinder to cause movement of the respective associated pistons; wherein the method comprises:

operating the device in a first mode of operation in which the valve system directs pressurised hydraulic fluid to the edging hydraulic cylinder to impart a pressure on the edging hydraulic cylinder to effect a first movement of the chock during an edging pass of a metal plate, and switching the device to a second mode of operation in which:

(a) the valve system directs the pressurised hydraulic fluid to the further hydraulic cylinder to impart a pressure on the further hydraulic cylinder sufficient to effect a second movement of the chock and a corresponding movement of the edging hydraulic cylinder between successive edging passes of the metal plate, the second movement of the chock having a greater magnitude than the first movement of the chock and (b) the pressure imparted on the edging hydraulic cylinder by the pressurised hydraulic fluid during the first mode of operation is relieved.

9. The method according to claim 8, wherein the device further comprises an additional source of hydraulic fluid and the method further comprises directing the hydraulic fluid therefrom to the edging hydraulic cylinder in the second mode of operation.

10. The method according to claim 8, further comprising providing by a conduit fluid communication between regions of an interior of the edging hydraulic cylinder on first and second sides of the piston associated with the edging hydraulic cylinder and a valve operable to block said fluid communication.

11. The method according to claim 10, wherein the conduit and the valve are embedded in the piston associated with the edging hydraulic cylinder.

12. The method according to claim 8, wherein the device further comprises at least one piston rod connected to the piston associated with the edging hydraulic cylinder and caused to move in an axial direction thereby; and wherein the piston rod is also connected to the chock by a connection allowing movement of the chock relative to the piston rod in a direction at a right angle to the axial direction.

13. The method according to claim 8, comprising directing said pressurised hydraulic fluid to the further hydraulic cylinder at a constant pressure in the first mode of operation to maintain contact between the chock and the piston associated with the edging hydraulic cylinder.

14. The method according to claim 13, further comprising determining the position of the further hydraulic cylinder and directing said pressurised hydraulic fluid to the further hydraulic cylinder responsive to said position in the second mode of operation by the controllable valve system.

* * * * *

UNITED STATES PATENT AND TRADEMARK OFFICE

CERTIFICATE OF CORRECTION

PATENT NO. : 9,016,100 B2
APPLICATION NO. : 13/260622
DATED : April 28, 2015
INVENTOR(S) : Michael Trevor Clark et al.

It is certified that error appears in the above-identified patent and that said Letters Patent is hereby corrected as shown below:

Title Page

Item (30) Foreign Application Priority Data is missing. Please add:

Mar. 27, 2009 (GB).....0905263.0

Signed and Sealed this
Eleventh Day of August, 2015

Michelle K. Lee

Michelle K. Lee
*Director of the United States Patent and Trademark Office*